US005111650A

United States Patent [19]

Lossa et al.

[11] Patent Number: 5,111,650

[45] Date of Patent: May 12, 1992

[54] APPARATUS FOR REFILLILNG A YARN WETTING AGENT INTO A YARN WETTING DEVICE FOR A TEXTILE MACHINE

[75] Inventors: Ulrich Lossa, Krefeld; Heinz Stenmans, Grefrath, both of Fed. Rep. of Germany

[73] Assignee: Palitex Project Company GmbH, Krefeld, Fed. Rep. of Germany

[21] Appl. No.: 550,112

[22] Filed: Jul. 9, 1990

[30] Foreign Application Priority Data

Jul. 22, 1989 [DE] Fed. Rep. of Germany ..... 3924359

[51] Int. Cl.[5] ..... D01H 1/10; D01H 13/30

[52] U.S. Cl. ..... 57/296; 57/58.83; 57/355

[58] Field of Search ..... 137/426, 398, 386, 255, 137/263, 572, 883; 57/295-297, 309, 58.49, 58.52, 58.83, 355; 141/113, 346-347; 222/67; 184/7.4

[56] References Cited

U.S. PATENT DOCUMENTS

| | | | |
|---|---|---|---|
| 1,109,832 | 8/1914 | Graham et al. | 222/67 X |
| 2,384,628 | 8/1945 | Krone et al. | 141/113 |
| 2,622,698 | 12/1952 | Chew | 184/7.4 X |
| 2,930,432 | 3/1960 | Engstrom | 137/398 |
| 3,864,901 | 2/1975 | Beymes et al. | 57/58.83 X |
| 3,928,711 | 12/1975 | Jakobsen | 137/883 X |
| 4,573,314 | 3/1986 | Lorenz | 57/296 |

FOREIGN PATENT DOCUMENTS

| | | |
|---|---|---|
| 1560226 | 8/1970 | Fed. Rep. of Germany . |
| 2554857 | 6/1976 | Fed. Rep. of Germany . |
| 2533269 | 1/1977 | Fed. Rep. of Germany . |
| 2558474 | 7/1977 | Fed. Rep. of Germany . |
| 2627268 | 12/1977 | Fed. Rep. of Germany . |
| 2434899 | 4/1985 | Fed. Rep. of Germany . |
| 3409233 | 10/1985 | Fed. Rep. of Germany . |

OTHER PUBLICATIONS

Prospekt, Instant-Lubritwist, Fa. Volkmann, Jun., 1976, S. 3-20.

Prospekt, TM-B DD-Zwirnmaschine, Technische Information, der Fa. Saurer-Allma, 1983.

*Primary Examiner*—Daniel P. Stodola
*Assistant Examiner*—William Stryjewski
*Attorney, Agent, or Firm*—Bell, Seltzer, Park & Gibson

[57] ABSTRACT

An apparatus for refilling a yarn wetting agent into a yarn wetting device of a yarn processing station of a textile machine, in particular a two-for-one twisting spindle, is characterized in that a filling station is either provided in the region of each yarn processing station of the textile machine or adapted to move to the yarn processing station, which is connected via a conduit with a storage tank of the wetting agent.

6 Claims, 5 Drawing Sheets

APPARATUS FOR REFILLILNG A YARN WETTING AGENT INTO A YARN WETTING DEVICE FOR A TEXTILE MACHINE

FIELD, BACKGROUND AND OBJECT OF THE INVENTION

The present invention relates to an apparatus for refilling a yarn wetting agent into a yarn wetting device of a yarn treatment station of a textile machine, in particular a two-for-one twisting spindle.

Such yarn wetting devices are described, for example, in U.S. Pat. No. 4,573,314.

In order to ensure for successive yarn treatment processes, for example, two-for-one twisting processes an as uniform application of a wetting agent as possible to the yarn, it is necessary to maintain, if possible, a most uniform level of the wetting agent, which should fluctuate only within certain predetermined limits.

Having the foregoing in mind, it is the object of the present invention to create an apparatus, which allows to maintain, without much expenditure in personnel, time and equipment, this possibly most uniform level of the wetting agent in its storage tank in the course of successive yarn treatment processes, in particular two-for-one twisting processes.

By this invention the above object is accomplished by providing apparatus for refilling storage tanks of wetting or lubricating devices at each spindle assembly of a textile machine having a plurality of such spindle assemblies for processing yarn which runs along the spindle assembly axis. Each of the spindle assemblies includes a yarn wetting or lubricating device of the type discussed above having a storage tank for containing a wetting agent and a porous wetting body extending into the tank for absorbing the wetting agent by capillary action and being positioned along the spindle assembly axis in the path of the running yarn for applying wetting agent to the running yarn during yarn processing and which must be removed from the spindle axis and running yarn path between the end of one yarn processing operation and the start-up of another yarn processing operation in order to be able to don and doff supply packages of yarn being processing and wound packages of yarn having been processed. The refilling apparatus which is mounted at each spindle assembly of the textile machine refills the storage tank of the wetting device when the wetting device is removed from the spindle axis and running yarn path. The apparatus comprises a supply tank for containing wetting agent, conduit means connected at one end to the supply tank and leading therefrom to each of the spindle assemblies for conveying wetting agent, and valve means mounted at each of the spindle assemblies and connected to the conduit means. Cooperating valve means are provided in the storage tank of the wetting device for connecting with the refilling apparatus valve means and allowing filling of the wetting device storage tank with wetting agent from the refilling apparatus.

Preferably, the refilling apparatus valve means and the wetting device valve means comprise respective male and female connector means in the form of a protruding tube in the refilling apparatus valve means and a recess in the wetting device valve means. Such recess in the wetting device valve means may include an annular seal for sealing the protruding tube when received therein. The refilling apparatus may include a level regulator means positioned in the conduit means between the supply tank and the valve means for regulating the amount of wetting agent filled into the wetting device.

Preferably, each of the filling apparatus valve means and the wetting device valve means include a valve seat and a movable valve body biased into engagement with the valve seat. The valve body of the refilling apparatus valve means includes a stem-shaped extension projecting outwardly of the valve means for engaging the biased valve body of the wetting device valve means and opening both of the valve means when both of the valve means are connected together. Each of the valve means further includes a locking and return spring biasing the respective valve body into engagement with the respective valve seat. The biasing force of each of the springs is adapted to each other to allow opening of both of the valve means when the valve means are connected together.

The fact that it is possible to position in the region of each yarn treatment station, in particular each two-for-one twisting position, a refilling station at the yarn treatment position, either when needed or constantly, for example, to make same available as a part of a manually operated maintenance carriage, allows to refill a yarn wetting device each time between two yarn treatment processes with an adequate quantity of the wetting agent, and without much expenditure in personnel, time and equipment. To this end, it will be necessary to provide for measures, which allow to obtain a certain level of the wetting agent in the storage tank with each refill. The quantity of the wetting agent used during a yarn treatment process leads to a lowering of the level of the wetting agent in the storage tank. However, this change in the level of the wetting agent results during a yarn treatment process in only a tolerable fluctuation of the quantity of the wetting agent applied to the yarn at a position of application.

The subclaims deal with preferred, further developments of the basic concept of the present invention.

BRIEF DESCRIPTION OF THE DRAWINGS

The invention will be described below in greater detail with reference to the drawing, in which.

DETAILED DESCRIPTION OF PREFERRED EMBODIMENT

Figure 1:
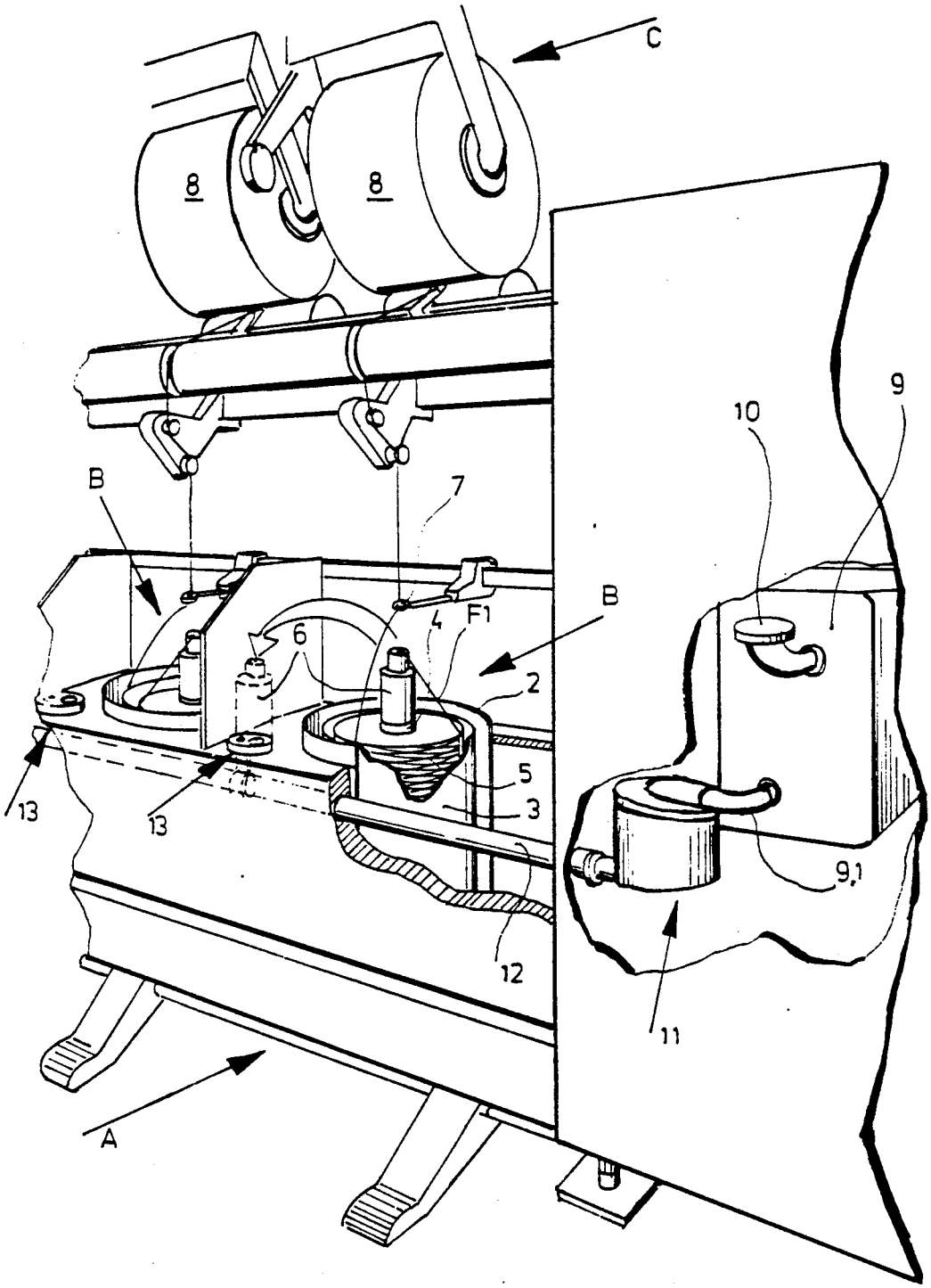
FIG. 1 is a perspective, partially sectional view of a portion of a two-for-one twisting machine with an associated refilling device integrated into the machine.

Illustrated in FIG. 1 is a portion of the front of a two-for-one twister A with two two-for-one twisting positions B, to which takeups C are associated. Shown of the two-for-one twisting position B are a balloon limiter 2 with a protective pot 3 inserted therein, as well as a package adapter 4 inserted on the spindle shaft not shown, which carries at least one feed yarn package or assembly-wound package 5. A yarn wetting device 6 is inserted on the upper side of the package adapter 5.

A yarn F1 unwinds overhead from the assembly-wound package 5 and enters from top into the hollow shaft of the yarn wetting device 6, before it passes through the package adapter 4 and the hollow spindle shaft not shown and leaves same in radial direction through a standard yarn storage disk, whence it advances, while forming a yarn balloon, through a yarn guide eyelet 7 located along the extension of the spindle shaft, and after having passed therethrough, is cross-wound to a package 8 in the region of the takeup C comprising known standard elements.

Accommodated in a cabinet at the front side of the two-for-one twister A is storage tank 9 for the wetting agent, which is provided with a filler tube 10. This storage tank 9 is connected, via a level regulator 11, to a conduit 12 extending along the front side of the two-for-one twister, which is provided with a filling station 13 in the region of each twisting position B. FIG. 1 shows in dashed lines a yarn wetting device 6, which is placed on a filling station 13 in the region of a twisting position B.

Figure 2:
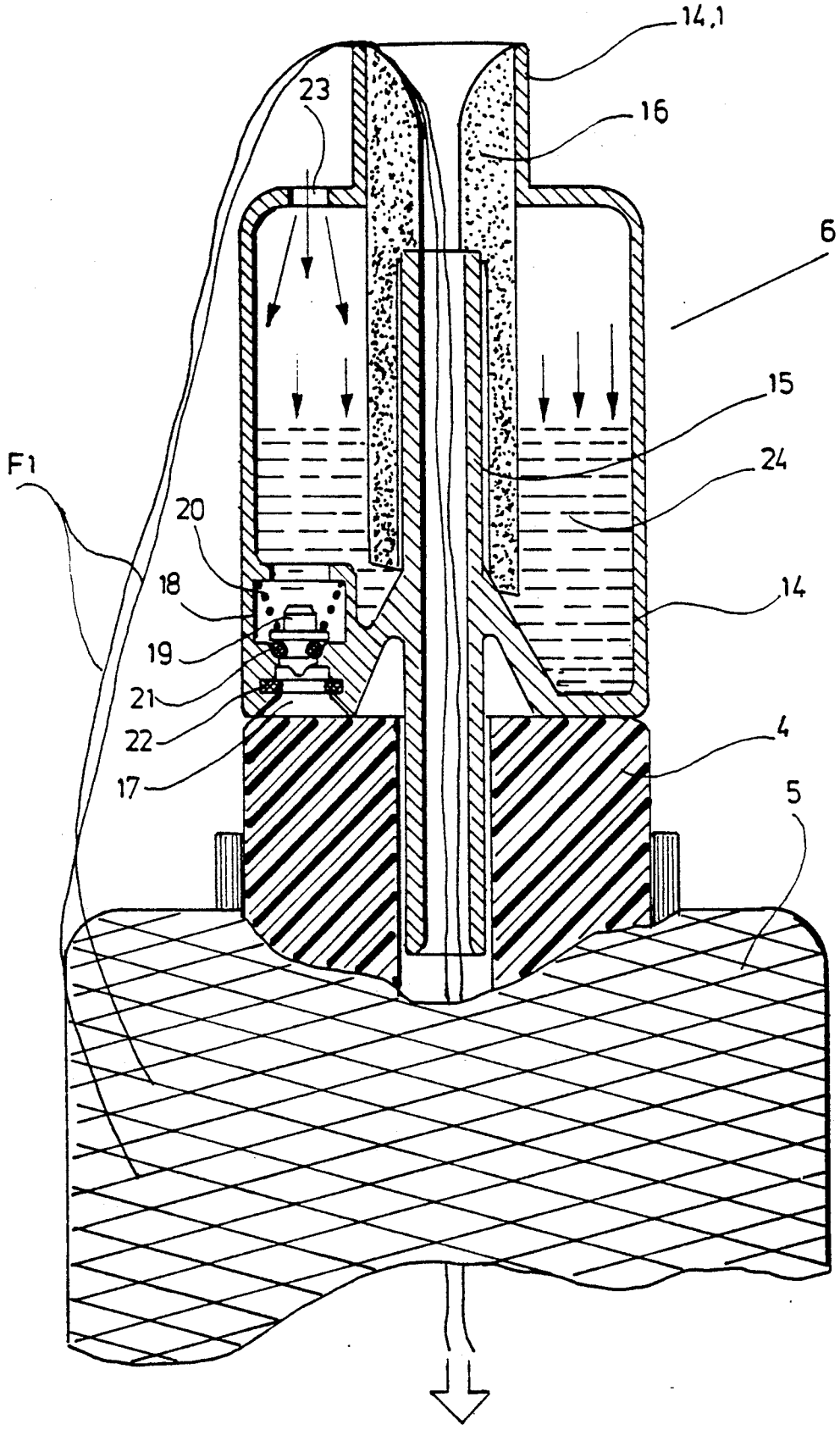
FIG. 2 is an axial sectional view of the upper portion of an adapter carrying a feed yarn package or assembly-wound package and a yarn wetting device inserted thereon.

FIG. 2 shows the upper portion of a package adapter 4 with two superposed assembly-wound packages or feed yarn packages 5, which can be seen in that two yarns F1 are withdrawn upward and enter into the hollow shaft of the yarn wetting device 6. This yarn wetting device 6 comprises a tubular storage tank 14 with a tubular member 15 extending through its bottom, which comprises a tubular section located in the interior of the storage tank and a tubular section projecting downward from the storage tank 14, by which the latter is inserted into the hollow shaft of the package adapter 4. On its upper side, the storage tank 14 is provided with an opening defined by a tubular piece 14.1, into Which a wetting body 16 in the form of an annular, rigid body of rotation of a porous material with capillary action is inserted. The surface of the wetting body 16, over which the two yarns F1 pass, as shown in FIG. 2, is inward directed and spherical. The wetting body 16 is provided with an annular support shoulder, which rests against the upper edge of the tubular member 15.

The bottom of storage tank 14 is provided with an opening 17, which flares out downwardly, preferably in the shape of a funnel, and terminates in a valve chamber 18 on its upper side. This valve chamber 18 accommodates a valve body 19, which is pressed With its annular seal 21 by the action of a locking and return spring 20 against a valve seat in the bottom of the valve chamber 18. An annular seal, preferably in the form of a lip seal 22 is inserted into the inside wall of the opening or bore 17.

Arranged in the upper region of the storage tank 14 is an opening 23 terminating in the surrounding atmosphere, so that the wetting agent 24, which is filled into the storage tank 14, is under atmospheric pressure.

Figure 3:
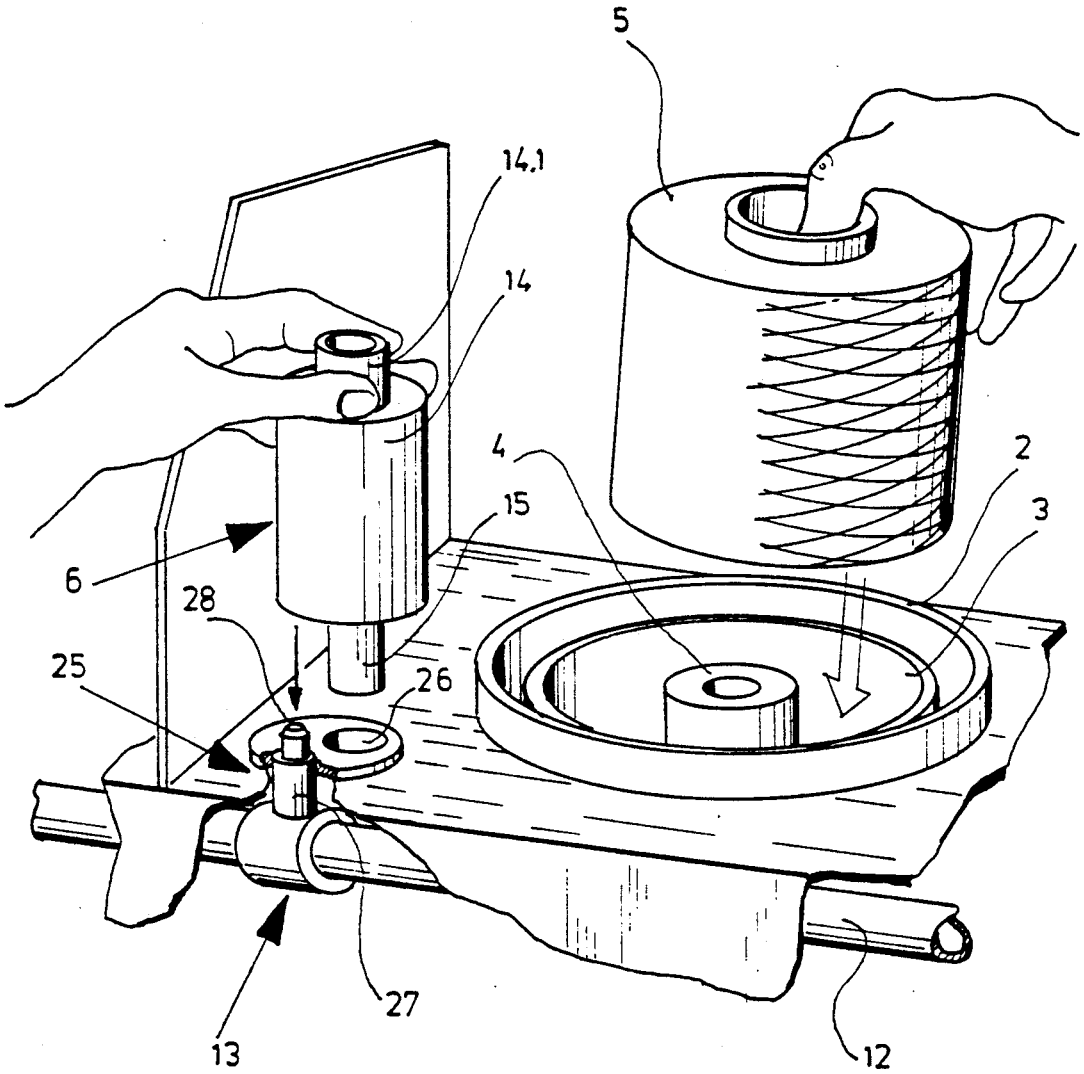
FIG. 3 is a perspective top view of a portion of a two-for-one twisting spindle with an associated filling station.

FIG. 3 illustrates a condition, in which the package adapter 4 is about to receive a new feed yarn or assembly-wound package 5, after the yarn wetting device 6 was previously removed from the adapter 4, and after the empty tube of a fully unwound, previous feed yarn package was likewise removed from the adapter 4. In FIG. 3, the yarn wetting device 6 is in a position shortly before it is inserted on the filler tube 25 of the filling station 13. FIG. 3 shows a preferably cylindrical opening 26 adjacent to the filler tube 25, to receive the portion of the tubular member 15 projecting from the bottom of storage tank 14. This inlet opening 26 serves, in connection with the tubular piece 15, for a reliable guiding and accurate positioning of the storage tank 14, when same is inserted on the filler tube 25 to receive a refill of the wetting agent.

The filler tube 25 comprises a tubular connection 27 inserted into the conduit 12 in a vertical position, in which a valve chamber is formed to receive a valve body 28, which is pressed by a locking and return spring 29 against an annular valve seat located on the upper side of the tubular connection 27. When the valve body 28 occupies its closing position, it projects from the tubular connection 27 in upward direction with an extension forming a stem.

Figure 4:
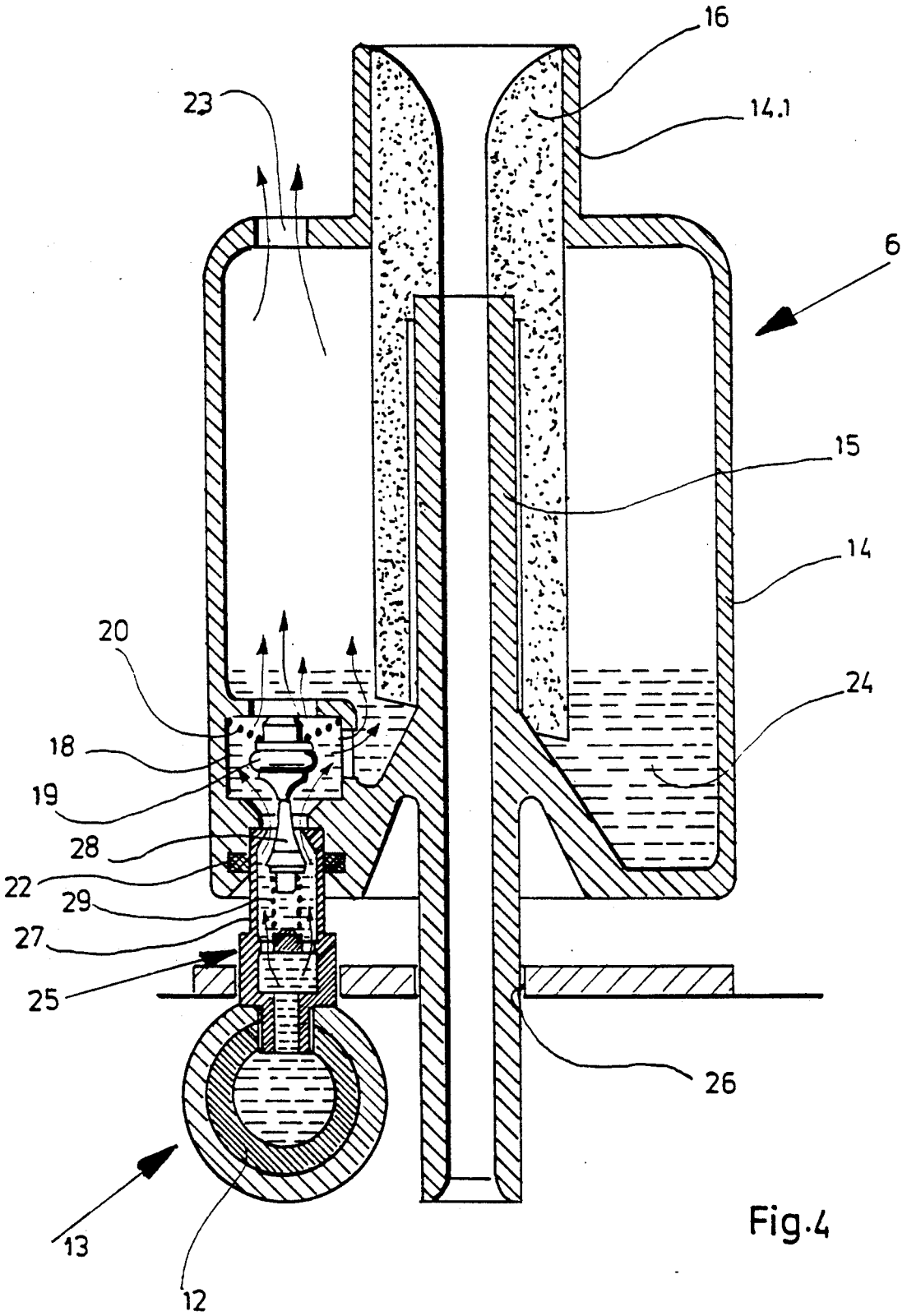
FIG. 4 is a sectional view of a yarn wetting device when connected with a filling station.

When, as shown in FIG. 4, the filler tube 25 with its tubular connection 27 is inserted into the underside of the storage tank 14, the stem-shaped extension of the valve body 28 in filler tube 25 comes to lie against the underside of the valve body 19, so that the two valve bodies are raised from their seats, with the forces of the two locking and return springs 20 and 29 being correspondingly adapted, and that a connection results between the interior of conduit 12 and the interior of storage tank 14. The valves opened in this manner allow the wetting agent 24 to flow from the conduit 12 into the storage tank 14, with the displaced air escaping through the opening 23.

Figure 5:
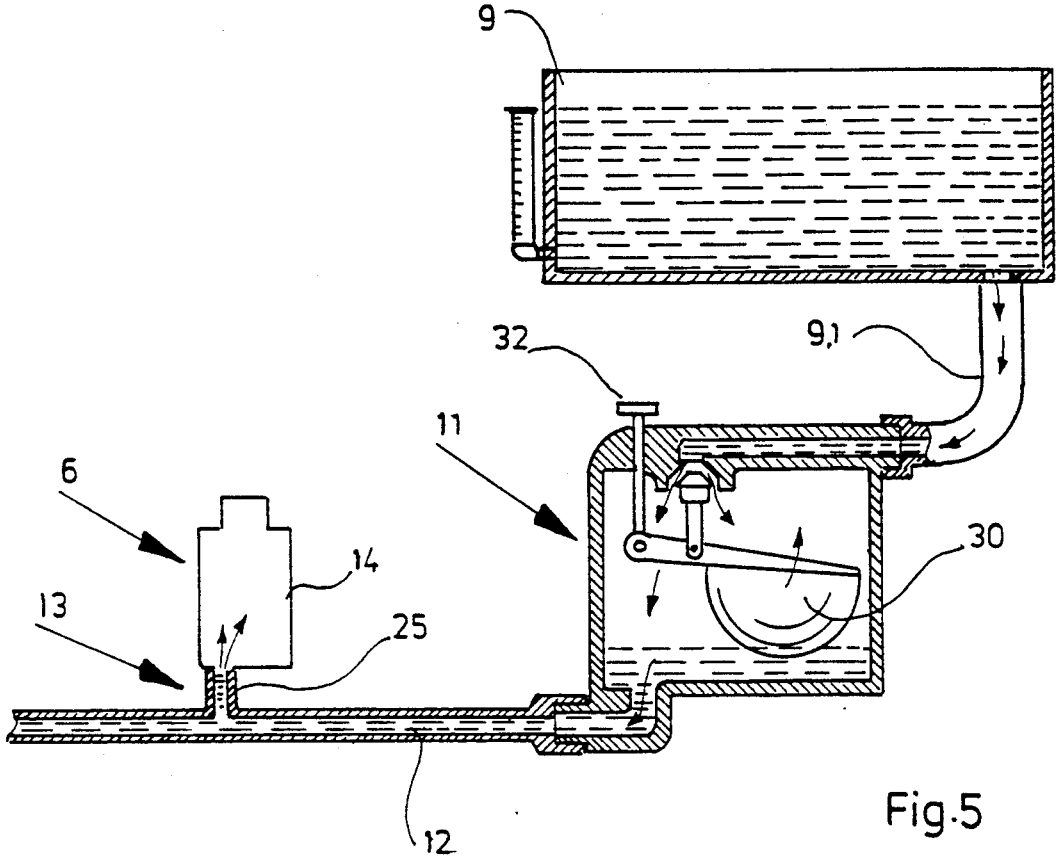
FIGS. 5 and 6 are schematic, sectional views of a portion of a supply system for the wetting agent.

FIGS. 5 and 6 are again cross sectional views of the storage tank 9 for the wetting agent, which is connected, via a line 9.1, with the level regulator 11, which is followed by a conduit 12. Inserted on the filler tube 25 of a filling station 13 is the storage tank 14 of a yarn wetting device 6 for the purpose of refilling it with the wetting agent 24.

The level regulator 11 comprises a valve body 31 controlled by a float 30, which interrupts the connection between the level regulator and the storage tank 9 of the wetting agent at a corresponding height of the wetting agent inside the level controller. As soon as the level in the regulator 11 drop below a certain height, the valve body 31 controlled by float 30 is adjusted to such an extent that the wetting agent can flow from the storage tank 9 into the level regulator 11 An adjusting pin 32 projecting from the region of the cover of level regulator 11, serves to manually adjust the radius of action of the float 30 and, thus, to regulate the filling level or height inside the regulator 11.

Figure 6:
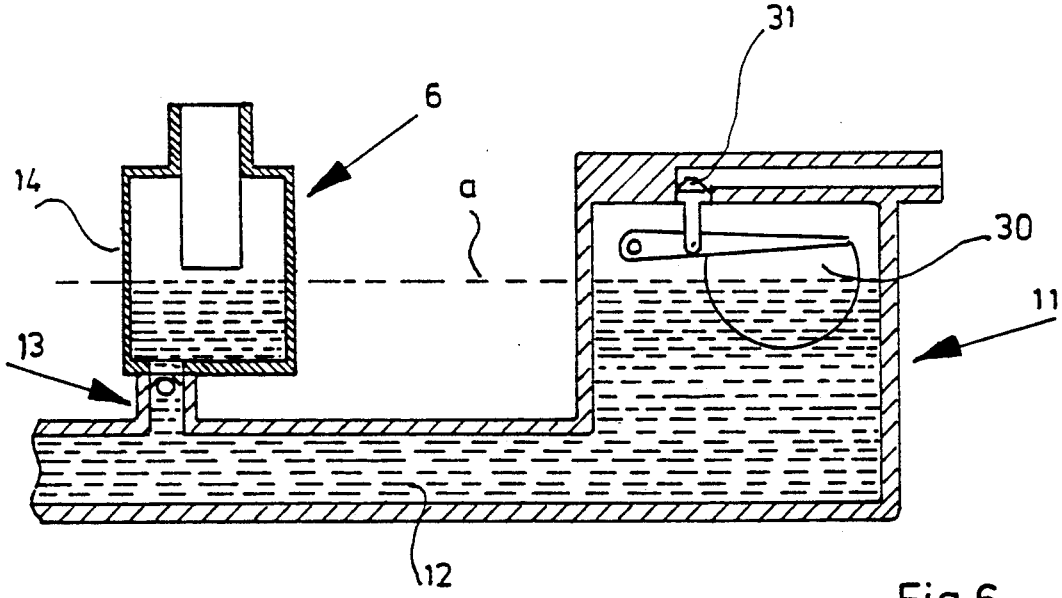

The level regulator 11 ensures by its own corresponding elevation or by a corresponding filling level in its interior that, when a storage tank 14, as shown in FIG. 4, is inserted on the filler tube 25, and the two valve bodies 19 and 28 occupy their opened positions, the storage tank 14 is refilled to a predetermined level such as is shown by the dashed line a of FIG. 6.

The level regulator 11 is provided in its upper region with a vent not shown.

Once the refilling of the storage tank 14 is completed, the two valve bodies return to their closing positions, when the storage tank 14 is raised from the filler tube 27.

Likewise it is possible to provide a filling station as a part of, for example, a hand-operated servicing carriage, which will then accommodate a storage tank 9 of the wetting agent, a level regulator 11, as well as the necessary connecting lines.

What is claimed:

1. In a textile machine having a plurality of spindle assemblies for successive processing of supply packages of yarn which runs along the spindle assembly axis, each of said spindle assemblies including a yarn wetting device having a storage tank for containing a wetting agent and a porous wetting body extending into said tank for absorbing the wetting agent by capillary action and being positioned along the spindle assembly axis in the path of the running yarn for applying wetting agent to the running yarn during yarn processing and which must be removed from the spindle axis and running yarn path between successive yarn processing operations; the combination therewith of:

apparatus for refilling said storage tank of each of said wetting devices when said wetting device is removed from the spindle axis and running yarn path and comprising a supply tank for containing wetting agent, conduit means connected at one end to said supply tank and leading therefrom to each of said spindle assemblies out of the spindle assembly axis and running yarn path for conveying wetting agent, and valve means mounted at each of said spindle assemblies and connected to said conduit means, and cooperating valve means in said storage tank of said wetting device for connecting with said refilling apparatus valve means and allowing filling of said wetting device storage tank with wetting agent from said refilling apparatus.

2. In a textile machine, as set forth in claim 1, in which said refilling apparatus valve means and said wetting device valve means comprise respective male and female connector means in the form of a protruding tube in said refilling apparatus valve means and a recess in said wetting device valve means.

3. In a textile machine, as set forth in claim 2, in which said recess in said wetting device valve means includes an annular seal.

4. In a textile machine, as set forth in claim 1, 2 or 3, in which each of said refilling apparatus valve means and said wetting device valve means include a valve seat and a movable valve body biased into engagement with said valve seat, and in which said valve body of said refilling apparatus valve means includes a stem-shaped extension projecting outwardly of said valve means for engaging said biased valve body of said wetting device valve means and opening both of said valve means when both of said valve means are connected together.

5. In a textile machine, as set forth in claim 4, in which each of said valve means further includes a locking and return spring biasing said respective valve body into engagement with said respective valve seat, and in which the biasing force of each of said springs is adapted to each other to allow opening of both of said valve means when said valve means are connected together.

6. In a textile machine, as set forth in claim 5, in which said refilling apparatus further includes a level regulator means positioned in said conduit means between said supply tank and said valve means for regulating the amount of wetting agent filled into said wetting device.

* * * * *

UNITED STATES PATENT AND TRADEMARK OFFICE

CERTIFICATE OF CORRECTION

PATENT NO. : 5,111,650

DATED : May 12, 1992

INVENTOR(S) : Ulrich Lossa and Heinz Stenmans

It is certified that error appears in the above-indentified patent and that said Letters Patent is hereby corrected as shown below:

Column 3, line 36, "Which" should be --which--.

Column 3, line 48, "With" should be --with--.

Signed and Sealed this

First Day of February, 1994

Bruce Lehman

*Attest:*

BRUCE LEHMAN

*Attesting Officer*

*Commissioner of Patents and Trademarks*